United States Patent [19]

Eisele et al.

[11] Patent Number: 4,938,813

[45] Date of Patent: Jul. 3, 1990

[54] SOLID ROCKET FUELS

[75] Inventors: Siegfried Eisele, Karlsruhe; Klaus Menke, Bruchsal; Hiltmar Schubert, Walzbachtal, all of Fed. Rep. of Germany

[73] Assignee: Fraunhofer-Gesellschaft zur Forderung der angewandten Forschung e.V., Munich, Fed. Rep. of Germany

[21] Appl. No.: 424,909

[22] Filed: Oct. 23, 1989

[30] Foreign Application Priority Data

Oct. 21, 1988 [DE] Fed. Rep. of Germany ..... 3835854

[51] Int. Cl.[5] ..... C06B 45/10

[52] U.S. Cl. ..... 149/19.2; 149/19.1; 149/19.4; 149/19.6; 149/92

[58] Field of Search ..... 149/19.2, 19.4, 19.6, 149/19.1, 92

[56] References Cited

U.S. PATENT DOCUMENTS

| | | | |
|---|---|---|---|
| 3,870,578 | 3/1975 | Nichols | 149/19.4 |
| 3,883,374 | 5/1975 | Rosher | 149/19.8 |
| 4,263,071 | 4/1981 | Bain et al. | 149/19.6 |
| 4,288,262 | 9/1981 | Flanagan et al. | 149/19.6 |
| 4,379,903 | 4/1983 | Reed et al. | 149/19.6 |
| 4,405,762 | 9/1983 | Earl et al. | 149/19.6 |
| 4,601,344 | 7/1986 | Reed et al. | 149/19.6 |
| 4,655,859 | 4/1987 | Sayles et al. | 149/19.2 |
| 4,707,199 | 11/1987 | Sayles | 149/19.2 |
| 4,726,919 | 2/1988 | Kristofferson et al. | 149/19.4 |

*Primary Examiner*—Edward A. Miller

*Attorney, Agent, or Firm*—Antonelli, Terry, Stout & Kraus

[57] ABSTRACT

Solid rocket fuels with a low pressure exponent and with little or no signature comprise high-energy nitramine compounds in an amount of 50–90% by weight, an azide group-containing, high-energy binder system of polymers and plasticizers in an amount of 8–50% by weight and heavy metal catalysts in the form of lead, tin or copper compounds in an amount of 0.5 to 10% by weight.

23 Claims, 2 Drawing Sheets

SOLID ROCKET FUELS

BACKGROUND OF THE INVENTION

The composite fuels based on ammonium perchlorate (AP)/aluminum (Al) now used as solid fuels for rockets have a high power, good processability, good mechanical characteristics and a flexible adjustable burn-up or burn-off behavior.

As a result of the use of AP or Al, said fuel types have a strong primary or secondary signature through $Al_2O_3$ or HCl in the exhaust gas. However, in the case of use on carrier-bound and field-bound weapon systems, the signature constitutes a serious disadvantage, because launch ramps and sites can be easily located by a smoke plume which can be seen from afar. A further disadvantage is the corrosive action of the exhaust gases.

In addition to AP/Al composite fuels, homogeneous double base fuel systems (DB) based on nitrocellulose (NC) and nitroglycerin (NG) have long been known and described in detail. DB fuels have a relatively weak signature, but have only limited power and unsatisfactory mechanical characteristics (thermoplastics).

In order to eliminate the aforementioned disadvantages of AP/Al composite fuels (strong signature and corrosive exhaust gases) or DB fuels (low power/poor mechanical characteristics), for a considerable time development has been taking place of alternative fuel systems with-energy components burning in smokeless manner and including the following:

Energy carriers:

Nitramine compounds, e.g. octogen, hexogen, nitroguanidine, pentraeythritol tetranitrate, tetryl, guanidine nitrate, triaminoguanidine nitrate, triaminotrinitrobenzene, ammonium nitrate, etc.

Inert Plasticizers:

e.g. glycerol triacetate, dibutyl phthalate.

High-energy plasticizers:

nitroglycerin (NB), butane triol trinitrate (BTTN), trimethylol ethane trinitrate (TMETN), diethylene glycol dinitrate (DEGDN), bis-dinitropropylformal/acetal (BDNPF/A), etc.

Inert binder:

e.g. polyester polyurethane elastomers, polyether polyurethane elastomers, polybutadiene polyurethane elastomers, etc.

The practical usability of the above fuel systems, particularly those containing nitramine, has hitherto failed as a result of the inadequate burn-off rates and the excessively high pressure exponent. The pressure exponent is a measure for the change in the burn-off rate as a function of the system pressure according to the formula $r=ap^n$ (in which r=the burn-off rate, p=the system pressure, a=const.). A reduction in the pressure exponent was noted in the case of DB fuels with nitramine content below 50% and inert polyurethane binders, as well as with additives constituted by heavy metal salts and carbon black. However, the burn-off rate remained at low values. As a result of the unfavorable mechanical characteristics and the poor thermoplastic processibility, the spectrum of characteristics is so unfavorable that these fuels have not been used in practice.

What is desired is a very low pressure exponent, so that in the case of any system pressure there is an identical and high burn-off rate.

When using inert binder systems, burn-off-moderating additives have no significant influence on the pressure exponent. Attempts have been made of late to replace inert binder systems (e.g. polyester polyurethanes) by azide group-containing binder systems, which lead to a power increase. These binders have a polyether-like or polyester-like chain structure containing energy-rich azide groups in the side chain. An example of an azide group-containing binder is a glycidyl azidodiol with the following structural unit:

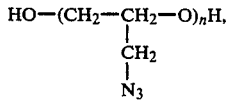

which can be cured with di- or triisocyanates (e.g. hexametholene diisocyanate) to elastomers (GAP). As GAP has a positive enthalpy of formation, solid fuels with this binder have higher power characteristics than those with inert binder systems. However, as in the case of standard formulations with inert binders, the pressure exponent of this fuel formation is much too high ($n>0.8$).

SUMMARY OF THE INVENTION

The problem of the present invention is to propose powerful solid fuels with a positive burn-off behavior.

According to the invention, this problem is solved by a fuel comprising high-energy nitramine compounds in amounts of 50–90% by weight (of the total weight of the fuel), a high-energy, azide group-containing binder system of polymers and plasticizers in amounts of 8–50% by weight and heavy metal catalysts in the form of lead, tin of copper compounds in amounts of 0.5–10% by weight.

DETAILED DESCRIPTION OF THE INVENTION

Figure 1:
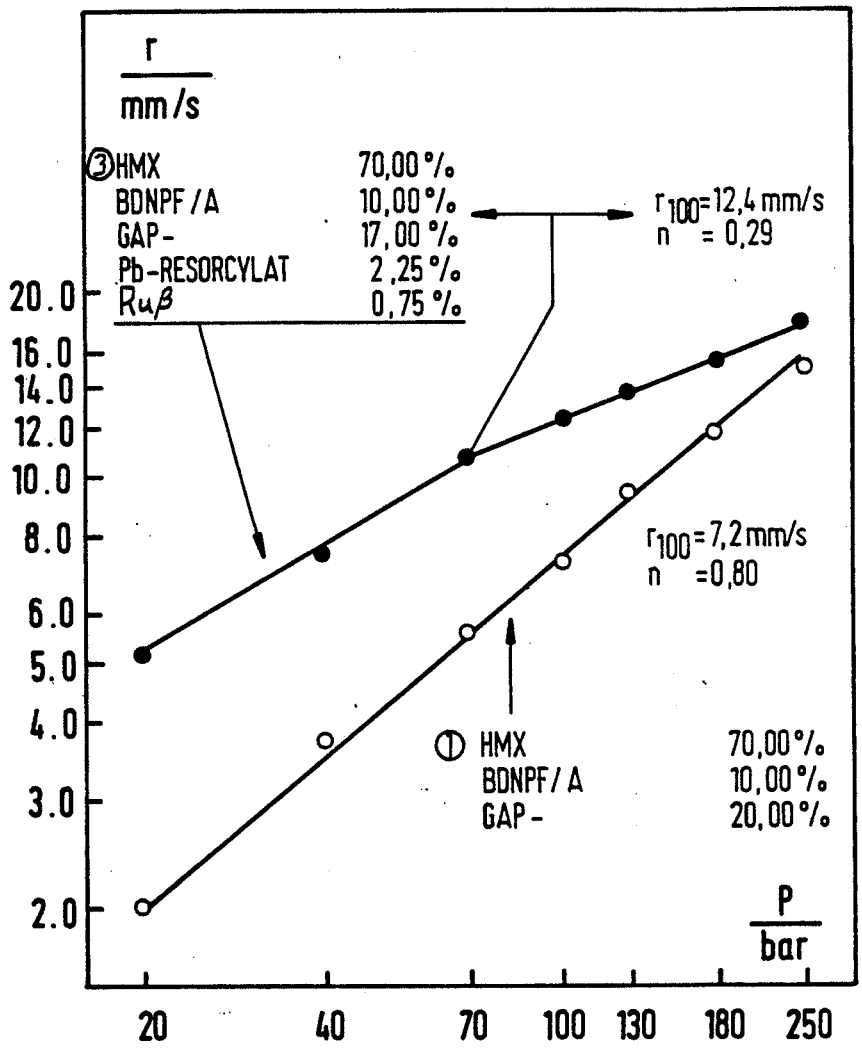
FIGS. 1 and 2 are graphs showing the burn-off rate as a function of system pressure for a known fuel and for fuels within the scope of the present invention.

The present invention therefore relates to fuel formulations based on energy carriers in the form of nitramines, a high-energy binder system in which either the polymer, or the plasticizer, or both contain azide groups and burn-off catalysts and moderators in the form of heavy metal compounds. The azide group-containing binder system can in particular comprise:

(a) azide polymers and high-energy and/or inert plasticizers, or (b) inert polymers and azide plasticizers, or (c) azide polymers and azide plasticizers.

The inventive fuels preferably comprise 60–85% by weight of solid, high-energy nitramine compounds which, on decomposition, form no corrosive gases and in the fuel lead to a burn-off with little or no smoke, i.e. having a minimum or no signature. There is a significant reduction to the pressure exponent ($n\leqq 0.6$) when combining with preferably 15–40% by weight of azide group-containing binders and preferably 1–5% by weight of heavy metal catalysts.

Preferably use is made of high-energy nitramine compounds, such as octogen, hexogen, nitroguanidine, tetryl, etc.

The azide group-containing binders used in the inventive fuel system can be present in the range 8–50%, and preferably 15–40%, by weight, and the actual binder contains 0–max 80%, and preferably 30–70%, by weight of plasticizer. In conjunction with the azide polymers, it is possible to use as energy-rich plasticizers all organic nitric acid esters or nitro compounds conventionally used in fuels. As relatively insensitive plasticizers, preference is given to the use of nitroglycerin, butane triol trinitrate, trimethylol ethane trinitrate, diethylene glycol dinitrate or bisdinitropropylformal/acetal.

In conjunction with the azide polymers and/or azide plasticizers, it is additionally possible to use inert plasticizers, such as alkyl acetates, preferably triacetin and/or phosphoric, phthalic, adipic or citric acid esters, preferably dibutyl, di-2-ethyl hexyl and dioctyl phthalate, dimethyl and dibutyl glycol phthalate, di-2-ethyl hexyl and diisooctyl adipate.

Curing to the azide polymer with a high elasticity and extensibility preferably takes place with trimeric isocyanates, such as e.g. biuret-trihexane diisocyanate or a combination of dimeric and trimeric isocyanates, the preferred dimeric isocyanates being hexamethylene diisocyanate, 2,4-toluene diisocyanate and isophorone diisocyanate. The equivalent ratios can vary, as a function of the solids proportion, between 0.4 and 1.2 NCO-/OH. The Pb, Sn or Cu compounds used as catalysts are preferably used in the form of oxides, organic salts (salicylates, stearates, citrates, resorcylates, etc.) or inorganic salts, but complex compounds can also be used.

In the case of the inventive combination of azide group-containing binder systems with the described heavy metal compounds, there is neither a deterioration of the chemical stability, nor a mechanical sensitivity (abrasion/impact sensitivity).

A further reduction to the pressure exponent can be brought about by adding small amounts of carbon or substances which yield carbon on burning. Preference is given to the use of carbon black, activated carbon, carbon fibers or graphite, their amount being between 0.2 and 3%, and preferably between 0.5 and 1%, by weight.

If from the use standpoint great importance is attached to the low pressure exponent, whereas the signature effect is less important, it is possible to add as power-increasing additives light metals, e.g. Al, in a proportion of 1 to 20% by weight, but these have a certain primary signature.

The solid rocket fuels formulated in the manner according to the invention can be used in all civil and military, rocketsupported systems. They have particular significance in the case of military battlefield systems, such as artillery tank, aircraft or ship defense rockets. As no corrosive gases are formed, unlike in the case cf AP-composite fuels, there is no harm to personnel or the launch site.

The characteristics resulting from the inventively formulated fuels have not been achieved by an hitherto known solid fuel type:

power higher than with double base fuels
pressure exponent $n<0.6$
burn-off rate at 100 bar: $r_{100}>9$ mm/s
better chemical stability than double base fuels
viscoelastic mechanical characteristics
greatly reduced primary and secondary signature with an almost smokeless burn-off, without adding metallic fuels
no corrosive exhaust gases.

In the attached table, column 1 gives a conventional solid fuel and columns 2 and 3 inventively composed solid fuels with their decisive characteristics for use. The high burn-off rate and very low pressure exponent of the inventive fuels are particularly noteworthy.

Figure 2:
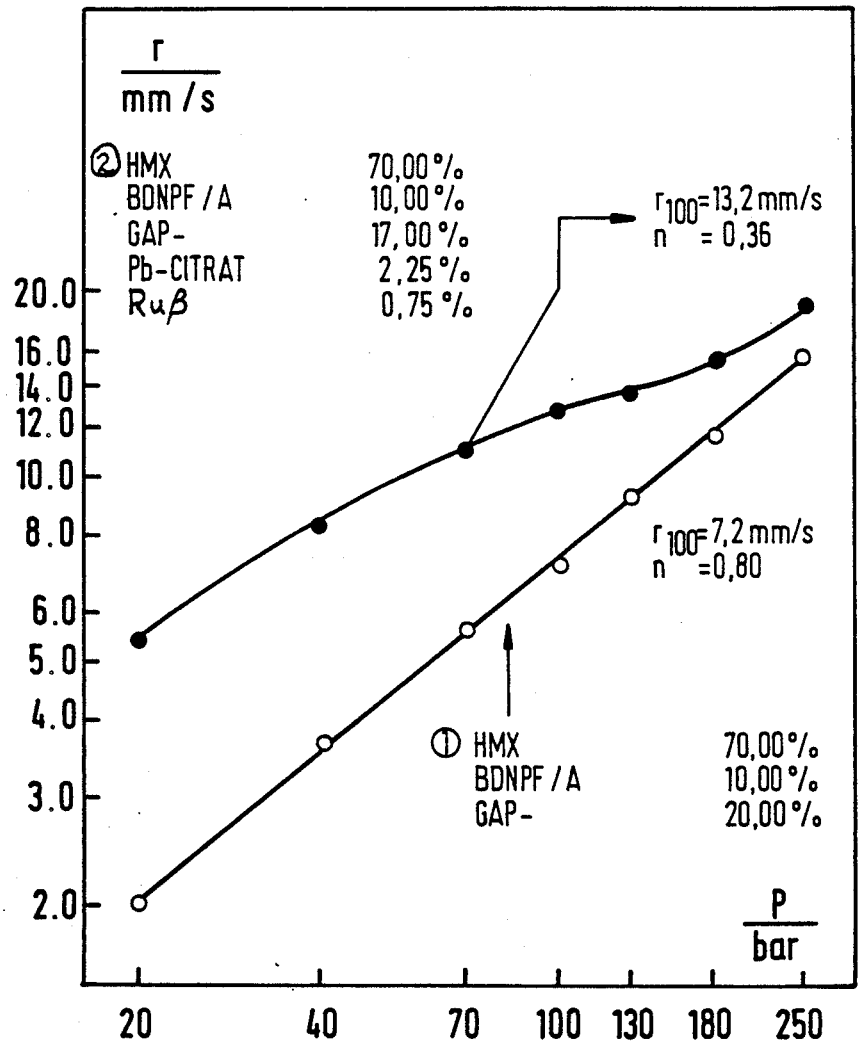

The graphs of FIGS. 1 and 2 show the burn-off rate r (mm/s) as a function of the system pressure P (bar) for the known fuel (column 1 in the table) compared with the examples of the inventively composed fuel given in columns 2 and 3 of the table.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

TABLE

| | No. 1 (FIG. 1 + 2) | No. 2 (FIG. 2) | No. 3 (FIG. 1) |
|---|---|---|---|
| HMX | 70.00% | 70.00% | 70.00% |
| BDNPF/A | 10.00% | 10.00% | 10.00% |
| GAP-Elastomer | 20.00% | 17.00% | 17.00% |
| Carbon Black | — | 0.75% | 0.75% |
| Pb-resorcylate | — | — | 2.25% |
| Pb-citrate | — | 2.25% | — |
| Abrasion sensitivity in kg pin loading | 18 kg | 14 kg | 16 kg |
| Impact sensitivity in Nm | 5.5 Nm | 6.5 Nm | 7.5 Nm |
| Holland Test 8–72 h/105° C., weight loss in % | 0.14% | 0.06% | 1.20% |
| Vacuum stability in ml/g 0–40 h/100° C. | 0.28 ml/g | 0.16 ml/g | 0.72 ml/g |
| Explosive combustion temperature in °C. (20° C./min) | 230° C. | 233° C. | 229° C. |
| Burn-off rate at 100 bar in mm/s | 7.2 mm/s | 13.2 mm/s | 12.4 mm/s |
| Pressure exponent n | 0.80 | 0.36 | 0.29 |
| | 70 bar p 180 bar | 70 bar p 250 bar | |

we claim:

1. Solid rocket fuels comprising high-energy nitramine compounds in an amount of 50–90% by weight, a high-energy, azide group-containing binder system of polymers and plasticizers in an amount of 8–50% by weight and heavy metal catalysts in the form of lead, tin or copper compounds in an amount of 0.5–10% by weight.

2. Solid rocket fuels according to claim 1, wherein the azide group-containing binder system is selected from the group consisting of:

(a) azide polymers and at least one of high-energy and inert plasticizers;
(b) inert polymers and azide plasticizers; and
(c) azide polymers and azide plasticizers.

3. Solid rocket fuels according to claim 1, wherein the nitramine compounds are used in an amount of 60–85% by weight, the azide group-containing binder system in an amount of 15–40% by weight and the heavy metal catalysts in an amount of 1–5% by weight.

4. Solid rocket fuels according to claim 1, wherein at least one selected from the group consisting of octogen, hexogen, nitroguanidine and tetryl is used as the nitramine compounds.

5. Solid rocket fuels according to claim 1, wherein the azide group-containing binder system contains 20–100% by weight of polymers and 0–80% by weight of high-energy plasticizers.

6. Solid rocket fuels according to claim 5, wherein the azide group-containing binder system contains 30–70% by weight of polymers and 30–70% by weight of high-energy plasticizers.

7. Solid rocket fuels according to claim 6, wherein the polymers are azide polymers, and the high-energy plasticizers are selected from the group consisting of esters and nitro compounds.

8. Solid rocket fuels according to claim 7, wherein said high-energy plasticizers are selected from the group consisting of nitroglycerine, butane triol trinitrate, trimethylol ethane trinitrate, diethylene glycol dinitrate, and bisdinitropropylformal/acetal.

9. Solid rocket fuels according to claim 5, wherein the polymers are azide polymers, and the high-energy plasticizers are selected from the group consisting of esters and nitro compounds.

10. Solid rocket fuels according to claim 9, wherein said high-energy plasticizers are selected from the group consisting of nitroglycerine, butane triol trinitrate, trimethylol ethane trinitrate, diethylene glycol dinitrate, and bisdinitropropylformal/acetal.

11. Solid rocket fuels according to claim 1, wherein the azide group-containing binder system includes at least one of polymers and azide plasticizers, and also includes an inert plasticizer selected from the group consisting of alkyl acetates, phthalates and adipates, and citric and phosphoric acid esters.

12. Solid rocket fuels according to claim 1, wherein the heavy metal catalysts in the form of lead, tin or copper compounds are selected from the group consisting of lead, tin or copper as oxides, inorganic salts and organic salts.

13. Solid rocket fuels according to claim 1, wherein the fuels additionally include burn-off moderators in the form of carbon or, on combustion, carbon-yielding substances, in an amount of 0.2 to 3% by weight.

14. Solid rocket fuels according to claim 13, wherein the burn-off moderators are selected from the group consisting of carbon black, carbon fibers, activated carbon and graphite.

15. Solid rocket fuels according to claim 1, wherein the fuels further include metal powders in an amount of 1–20%, as power-increasing additives.

16. Solid rocket fuels according to claim 2, wherein the nitramine compounds are used in an amount of 60–85% by weight, the azide group-containing binder system in an amount of 15–40% by weight and the heavy metal catalysts in an amount of 1–5% by weight.

17. Solid rocket fuels according to claim 16, wherein at least one selected from the group consisting of octogen, hexogen, nitroguanidine and tetryl is used as the nitramine compounds.

18. Solid rocket fuels according to claim 17, wherein the azide group-containing binder system contains 20–100% by weight of polymers and 0–80% by weight of high-energy plasticizers.

19. Solid rocket fuels according to claim 18, wherein the polymers are azide polymers, and the high-energy plasticizers are selected from the group consisting of esters and nitro compounds.

20. Solid rocket fuels according to claim 19, wherein the azide group-containing binder system includes at least one of polymers and azide plasticizers, and also includes an inert plasticizer selected from the group consisting of alkyl acetates, phthalates and adipates, and citric and phosphoric acid esters.

21. Solid rocket fuels according to claim 20, wherein the heavy metal catalysts in the form of lead, tin or copper compounds are selected from the group consisting of lead, tin or copper as oxides, inorganic salts and organic salts.

22. Solid rocket fuels according to claim 21, wherein the fuels additionally include burn-off moderators in the form of carbon or, on combustion, carbon-yielding substances, in an amount of 0.2 to 3% by weight.

23. Solid rocket fuels according to claim 21, wherein the fuels further include metal powders in an amount of 1–20%, as power-increasing additives.

* * * * *